US011486299B2

(12) United States Patent
Heller et al.

(10) Patent No.: US 11,486,299 B2
(45) Date of Patent: Nov. 1, 2022

(54) HYDRAULIC CONTROL VALVE FOR A LONGITUDINALLY ADJUSTABLE CONNECTING ROD WITH AN END-FACE CONTROL PISTON

(71) Applicants: IWIS MOTORSYSTEME GMBH & CO. KG, Munich (DE); AVL LIST GMBH, Graz (AT)

(72) Inventors: Malte Heller, Munich (DE); Kai Arens, Munich (DE); Zoltán Riba, Olching (DE); Martin Bodensteiner, Munich (DE); Steffen Latz, Munich (DE); Bernhard Kometter, Judendorf (AT); Helmut Melde-Tuczai, Graz (AT)

(73) Assignees: IWIS MOTORSYSTEME GMBH & CO. KG, Munich (DE); AVL LIST GMBH, Graz (AT)

( * ) Notice: Subject to any disclaimer, the term of this patent is extended or adjusted under 35 U.S.C. 154(b) by 0 days.

(21) Appl. No.: 17/283,233

(22) PCT Filed: Oct. 8, 2019

(86) PCT No.: PCT/AT2019/060335

§ 371 (c)(1),
(2) Date: Apr. 6, 2021

(87) PCT Pub. No.: WO2020/073068

PCT Pub. Date: Apr. 16, 2020

(65) Prior Publication Data

US 2021/0348550 A1 Nov. 11, 2021

(30) Foreign Application Priority Data

Oct. 8, 2018 (AT) ..... A 50871/2018

(51) Int. Cl.
*F02B 75/04* (2006.01)

(52) U.S. Cl.
CPC ..... *F02B 75/045* (2013.01)

(58) Field of Classification Search
CPC ..... F02B 75/045; F02D 15/02; F16C 7/06; F16K 31/12; F16K 31/44; F16K 31/52416
See application file for complete search history.

(56) References Cited

U.S. PATENT DOCUMENTS 4,124,002 A * 11/1978 Crise ..... F02B 75/045 123/78 E
4,140,091 A * 2/1979 Showers, Jr. ..... F16C 7/06 123/78 E
2015/0122077 A1* 5/2015 Melde-Tuczai ..... F16C 7/06 74/586

FOREIGN PATENT DOCUMENTS

AT 15006 U2 10/2016
AT 518563 A1 11/2017
(Continued)

*Primary Examiner* — Hung Q Nguyen
(74) *Attorney, Agent, or Firm* — BakerHostetler

(57) ABSTRACT

A longitudinally adjustable connecting rod for a piston engine, where the connecting rod includes a first connecting rod end for receiving a piston pin and a second connecting rod end for receiving a crankshaft journal, where the distance between the piston pin and the crankshaft journal is adjustable in the longitudinal direction (A) of the connecting rod by way of a hydraulic control device with a hydraulic control valve. The hydraulic control valve comprises a control cylinder and a control slide which is guided in a slidable manner in the control cylinder and which can be pressurized, and at least one outlet valve which can be actuated by the control slide. The control slide comprises a control piston which is arranged on the end face, with a control pressure surface which can be subjected to the hydraulic control pressure and which defines a control pressure chamber in the control cylinder. The use of such a (Continued)

longitudinally adjustable connecting rod with a hydraulic control device in a piston engine as well as a corresponding piston engine is also provided.

21 Claims, 4 Drawing Sheets

(56) References Cited

FOREIGN PATENT DOCUMENTS

| | | | | |
|---|---|---|---|---|
| CN | 104937238 | A | 9/2015 | |
| CN | 105814327 | A | 7/2016 | |
| CN | 108026834 | A | 5/2018 | |
| CN | 108603438 | A1 | 9/2018 | |
| DE | 10 2005 055 199 | A1 | 5/2007 | |
| DE | 102015011066 | B3 * | 10/2015 | ..... F02B 75/045 |
| DE | 10 2016 207 505 | A1 | 11/2017 | |
| EP | 1 426 584 | A1 | 6/2004 | |
| WO | 2013/092364 | A1 | 6/2013 | |
| WO | 2015/055582 | A2 | 4/2015 | |
| WO | 2016/203047 | A1 | 12/2016 | |
| WO | 2018/060457 | A1 | 4/2018 | |

* cited by examiner

HYDRAULIC CONTROL VALVE FOR A LONGITUDINALLY ADJUSTABLE CONNECTING ROD WITH AN END-FACE CONTROL PISTON

CROSS-REFERENCE TO RELATED APPLICATIONS

This application is a National Stage of International patent application PCT/AT2019/060335, filed on Oct. 8, 2019, which claims priority to foreign Austrian patent application No. AT A50871/2018, filed on Oct. 8, 2018, the disclosures of which are incorporated by reference in their entirety.

FIELD OF THE INVENTION

The present invention relates to a longitudinally adjustable connecting rod for a piston engine, where the connecting rod comprises a first connecting rod end for receiving a piston pin and a second connecting rod end for receiving a crankshaft journal, where the distance between the piston pin and the crankshaft journal is adjustable in the longitudinal direction of the connecting rod by way of a hydraulic control device, and where the hydraulic control device comprises a control cylinder and a control slide which is guided in a slidable manner in the control cylinder and which can be pressurized. The invention further relates to the use of such a longitudinally adjustable connecting rod and a piston motor with a longitudinally adjustable connecting rod.

BACKGROUND

For internal combustion engines with reciprocating pistons, efforts are being made to change the compression ratio during operation and to adapt it to the respective operating state of the engine in order to improve the thermal efficiency of the internal combustion engine. The thermal efficiency increases as the compression ratio rises, but too high a compression ratio can lead to unintentional spontaneous ignition of the piston engine. This early combustion does not only lead to spark ignition engines not running smoothly and so-called knocking of the engine, but can also lead to component damage in the engine. The risk of spontaneous ignition is less in the partial load range, so that a higher compression ratio is possible.

Various solutions exist for the realization of a variable compression ratio (VCR) with which the position of the crank pin of the crankshaft or the piston pin of the reciprocating piston is varied or the effective length of the connecting rod is varied. There are respective solutions for continuous and discontinuous adjustment of the components. Continuous length adjustment of the distance between the piston pin and the crankshaft journal enables the compression ratio to be adjusted in a sliding manner to the respective operating point and therefore enables optimal efficiency of the internal combustion engine. In contrast, discontinuous adjustment of the connecting rod length with a few steps results in structural and operational advantages and over a conventional piston engine, nevertheless enables significant improvement in efficiency and corresponding savings in consumption and pollutant emissions.

Discontinuous adjustment of the compression ratio for a piston engine is described in EP 1 426 584 A1 in which an eccentric connected to the piston pin of the reciprocating piston enables the compression ratio to be adjusted, where the eccentric is fixed in the respective end positions of the pivoting range by way of a mechanical lock. In contrast, DE 10 2005 055 199 A1 discloses a longitudinally adjustable connecting rod with which different compression ratios can be obtained, where the eccentric is fixed in its position by two cylinder-piston units and the hydraulic pressure difference of the engine oil supplied.

WO 2013/092364 A1 shows a longitudinally adjustable connecting rod with connecting rod members that can be slid telescopically into one another, where one connecting rod member comprises an adjustable piston and the second connecting rod member comprises a cylinder in which the adjustable piston is arranged to be movable longitudinally. This cylinder-piston unit is supplied with engine oil by way of a hydraulic control device with an oil valve that is dependent on the oil pressure for adjusting the length of the connecting rod.

A further telescoped longitudinally adjustable connecting rod is described in WO 2015/055582 A2, where the adjustable piston provided in the first connecting rod member divides the cylinder into two pressure chambers which are supplied with engine oil by way of a hydraulic control device. The two pressure chambers of this cylinder-piston unit are supplied with engine oil via check valves, where pressurized engine oil is present in only one pressure chamber. If the longitudinally adjustable connecting rod is in the long position, then there is no engine oil present in the upper pressure chamber, whereas the lower pressure chamber is completely filled with engine oil. During operation, the connecting rod is subjected to alternating pull and push forces due to the gas and mass forces. In the long position of the connecting rod, a pull force is absorbed by the mechanical contact with an upper stop of the adjustable piston. As a result, the connecting rod length does not change. An acting push force is transmitted via the piston surface to the lower pressure chamber filled with engine oil. Since the check valve in this chamber prevents the return flow of engine oil, the pressure of the engine oil rises so that the connecting rod is hydraulically blocked in this direction. The connecting rod length does not change there either. In the short position of the longitudinally adjustable connecting rod, the situation in the cylinder-piston unit is reversed. The lower pressure chamber is empty, whereas the upper pressure chamber is filled with engine oil. Accordingly, a pull force causes a pressure rise in the upper chamber and a hydraulic lock of the longitudinally adjustable connecting rod, while a push force is absorbed by the mechanical stop of the adjustable piston.

The connecting rod length of this longitudinally adjustable connecting rod can be adjusted in two stages in that one of the two pressure chambers is emptied, where one of the two check valves in the inlet duct is respectively bridged by way of a corresponding return flow duct. Engine oil flows through these return flow ducts between the pressure chamber and the engine oil supply, whereby the respective check valve loses its effect. The two return flow ducts are opened and closed by a hydraulic control device, where precisely one return flow duct is always open, and the other is closed. The actuator for switching the two return flow ducts is controlled hydraulically by the supply pressure of the engine oil, where the engine oil is supplied via respective hydraulic fluid ducts in the connecting rod and the bearing of the crankshaft journal in the second connecting rod end. The connecting rod length is then actively adjusted by selectively emptying the pressure chamber filled with engine oil by using the mass and gas forces acting upon the connecting rod, where the other pressure chamber is supplied with engine oil via the associated check valve and is hydraulically blocked.

In particular in the development of modern piston engines, the installation space for such connecting rods is limited both in the longitudinal direction of the connecting rod (axially) as well as radially. The installation space in the crankshaft direction is limited by the bearing width and the spacing of the counterweights. In the longitudinal direction, only the distance between the piston pin and the crankshaft journal is available anyway. In addition, the fatigue strength of the materials used is problematic in view of the high internal pressures in the adjustment mechanism employed. A further problem is the provision of the hydraulic control device with the various inlet, return flow, and supply ducts for engine oil and the necessary check and control valves which additionally weaken the components of the connecting rod.

SUMMARY OF THE INVENTION

It is therefore the object of the present invention to improve the configuration, manufacture, and function of a generic longitudinally adjustable connecting rod.

This object is satisfied according to the invention in that the control slide comprises a control piston which is arranged on the end face, where the control piston comprises a control pressure surface which can be subjected to the hydraulic control pressure and which defines a control pressure chamber in the control cylinder. In addition to the simple structure, this configuration of the hydraulic control valve enables reliable operation and precise control of the longitudinally adjustable connecting rod. Due to the end-face arrangement of the control piston, the control cylinder can be configured as a simple stepped bore and the hydraulic fluid ducts can be configured as simple bores. Furthermore, the control piston arranged at the end face enables a clear separation between the at least one outlet valve and the control pressure chamber for actuating the control slide. Due to the configuration according to the invention of the control slide for the hydraulic control valve of the longitudinally adjustable connecting rod, the requirements placed upon the tolerances of the components of the control valve as well as the sealing of the control piston against the control cylinder can be kept low. For a structurally simple configuration of the control slide, the control pressure surface that can be subjected to the hydraulic control pressure can be arranged on the end face on the control piston of the control slide. This enables drainage of the associated low-pressure chamber on the inner side of the control piston via the existing drainage of the at least one outlet valve. Alternatively, the control pressure surface can also be provided on the rear side of the control piston arranged on the end face, where a guide projection can be formed on the end face for guiding an optional return spring.

In an advantageous embodiment, the control slide can comprise a slide tappet, where the slide tappet extends from the control piston arranged at the end face into the control cylinder for actuating the at least one outlet valve. Such a mushroom-shaped control slide with a head-side control piston and a stem-like slide tappet enables the hydraulic control valve to be mounted on one side through a single opening in the longitudinally adjustable connecting rod. In addition, such a control slide facilitates the pre-assembly of several components or the entire control valve, whereby manufacturing costs can be reduced. In addition to the simple activation of the at least one outlet valve, the slide tappet of the control slide on the foot side also enables direct transmission of the axial motion of the control slide to a stroke motion of the outlet valves. For particularly simple transmission of the axial motion, the control tappet can comprise a switching contour for actuating the at least one outlet valve. The switching contour can be configured as a flattened portion of the slide tappet extending straight or inclined with or without depressions and projections.

An advantageous configuration provides that at least two outlet valves which can be actuated by the control slide be provided, where the at least two outlet valves are preferably able to be actuated alternately. Depending on the position of the control slide, one of the two outlet valves is open so that hydraulic fluid can escape either from the first pressure chamber or the second pressure chamber of the control device, in particular a double-action cylinder-piston unit, of the longitudinally adjustable connecting rod. Meanwhile, the other pressure chamber can simultaneously fill with hydraulic fluid due to the mass and gas forces acting in the piston engine during the stroke motion of the connecting rod which cause the check valve associated with the other pressure chamber to open due to the suction effect arising. With this pressure chamber filling increasingly, hydraulic fluid is increasingly discharged from the open pressure chamber, whereby the length of the connecting rod of the longitudinally adjustable connecting rod changes. Depending on the configuration of the adjustment mechanism, in particular of the control device, and depending on the operational state of the piston engine, several strokes of the connecting rod may be required until the change in length of the connecting rod has completed. The outlet valves advantageously have spring-preloaded valve bodies, preferably valve spheres, which are moved against the spring preload in the direction of the stroke axis of the valve body by way of a suitable transmission element, for example, transmission pins or transmission spheres, in order to open the outlet valve.

For reliable operation and a simple structure of the outlet valves, the at least two outlet valves can be arranged inclined relative to the control slide axis, preferably perpendicular to the control slide axis. The arrangement of the outlet valves relates to the opening direction of the valve bodies in the outlet valves. In addition to a simple structure of the hydraulic control valve, this inclined arrangement of the outlet valves enables overall small dimensions of the connecting rod with a corresponding reduction in mass. Furthermore, the inclined arrangement of the outlet valves can minimize disruptive influences of the outlet valves upon other components of the hydraulic control valve, and negative influences of the inertia of the hydraulic fluid in the hydraulic fluid ducts and the components of the hydraulic control device can be taken into account.

In an alternative embodiment, the at least two outlet valves can be arranged on oppositely disposed sides of the control slide axis, preferably perpendicular to the control slide axis. The oppositely disposed arrangement of the outlet valves enables a very compact design of the hydraulic control valve and thereby also a very slim design of the connecting rod.

The at least two outlet valves can advantageously be actuated alternately by the control slide. This enables the reliable operation of the hydraulic control device with the associated pressure chambers emptying alternately or the second other pressure chamber filling, respectively, as well as the secure positioning of the connecting rod in the longitudinal position that is set.

A preferred embodiment provides that the hydraulic control device comprises a return spring for retaining the control slide in a first initial position or to return it to the first initial position, where the return spring is preferably arranged around the control slide. The return spring makes it possible to provide two different switching positions in the hydraulic control valve without providing an active return mechanism, additional pressure chambers, or supply lines. As a result, the production costs can be kept low, while simultaneously increasing in operational reliability. Furthermore, such a return spring can be adapted in a simple manner to different control pressures or applications of the control valve without having to change the entire configuration of the hydraulic control device or even of the longitudinally adjustable connecting rod. The arrangement of the return spring around the control slide reduces the installation space required for the control valve and, at the same time, also reduces manufacturing costs. Alternatively, the return spring can also be arranged between the control piston and the face end of the control cylinder, for example, of a cylinder cover.

A special variant provides that the control slide be arranged inclined relative to the longitudinal direction of the connecting rod and inclined to the normal to the longitudinal direction of the connecting rod, preferably at an angle between 15° and 75°. The inclined arrangement of the control slide relative to the longitudinal direction of the connecting rod and relative to the normal to the longitudinal direction of the connecting rod can compensate for or at least reduce the negative influences of the inertia of the hydraulic fluid in the hydraulic fluid ducts and the components of the hydraulic control device, if the angle has been selected to be favorable. As a result, faults and malfunctions in the activation of the control device can be avoided. Furthermore, the inclined arrangement of the control slide also minimizes disruptive influences upon the other components of the hydraulic control device and the longitudinally adjustable connecting rod, the function of which can be impaired, in particular by the mass forces that increase sharply at high rotational speeds.

One embodiment of the longitudinally adjustable connecting rod provides that two connecting rod members be provided, where the first connecting rod member comprises the first connecting rod end and where the second connecting rod member comprises the second connecting rod end, and where the first connecting rod member is movable, is preferably telescopically movable, relative to the second connecting rod member in the longitudinal direction of the connecting rod for adjusting the distance between the piston pin and the crankshaft journal. In contrast to connecting rods with eccentrics, two connecting rod members that can be moved relative to one another in the longitudinal direction of the connecting rod enable a stable structure as well as reliable and permanent operation of the longitudinally adjustable connecting rod. At least one cylinder-piston unit hydraulically connected to the hydraulic control device can be provided for moving the first connecting rod member relative to the second connecting rod member, where the first connecting rod member is connected to an adjustable piston of the cylinder-piston unit and the second connecting rod member comprises a cylinder bore of the cylinder-piston unit. In addition to a very robust structure of the longitudinally adjustable connecting rod, this also enables simple and inexpensive connecting rod members, where the adjustable piston of the first connecting rod member is preferably connected directly to the piston rod and the connecting rod head to the first connecting rod end and the second connecting rod member comprises a housing in which the hydraulic control device is provided in addition to the cylinder bore.

The invention furthermore relates to the use of a longitudinally adjustable connecting rod with a hydraulic control valve in a piston engine, where the hydraulic control valve of the control device comprises a control cylinder and a control slide which can guided in a slidable manner in the control cylinder and which can be pressurized, as well as at least two outlet valves, where the control slide comprises a control piston arranged on the end face and the control piston comprises a control pressure surface which can be subjected to the hydraulic control pressure and which defines a control pressure chamber in the control cylinder. The control slide guided in a slidable manner in the control cylinder of the hydraulic control valve enables, by way of the control piston arranged at the end face, not only inexpensive manufacture and assembly of the control slide, but also reliable operation of the hydraulic control valve in the longitudinally adjustable connecting rod. The control pressure surface, which is arranged on the end-face control piston and can be subjected to the hydraulic control pressure, and the control pressure chamber in the control cylinder defined by the control pressure surface can facilitate reliable functioning of the hydraulic control valve.

In one further aspect, the invention relates to a piston engine with at least one engine cylinder, a reciprocating piston moving in the engine cylinder, and at least one adjustable compression ratio in the engine cylinder, as well as with a longitudinally adjustable connecting rod connected to the reciprocating piston according to the above-described embodiments. Preferably all of the reciprocating pistons of the piston engine are equipped with such a longitudinally adjustable connecting rod and the control device of the longitudinally adjustable connecting rod is connected to the engine oil hydraulics of the piston engine. The fuel saving effect of such a piston engine can be considerable when the compression ratio is adjusted accordingly in dependence of the respective operating condition. Cost-effective and robust control of the associated adjustment device of the longitudinally adjustable connecting rod is made possible by way of the hydraulic control device and the hollow slide.

BRIEF DESCRIPTION OF THE DRAWINGS

Non-restricting embodiments of the invention shall be explained in more detail below with reference to exemplary drawings, where.

DETAILED DESCRIPTION

Figure 1:
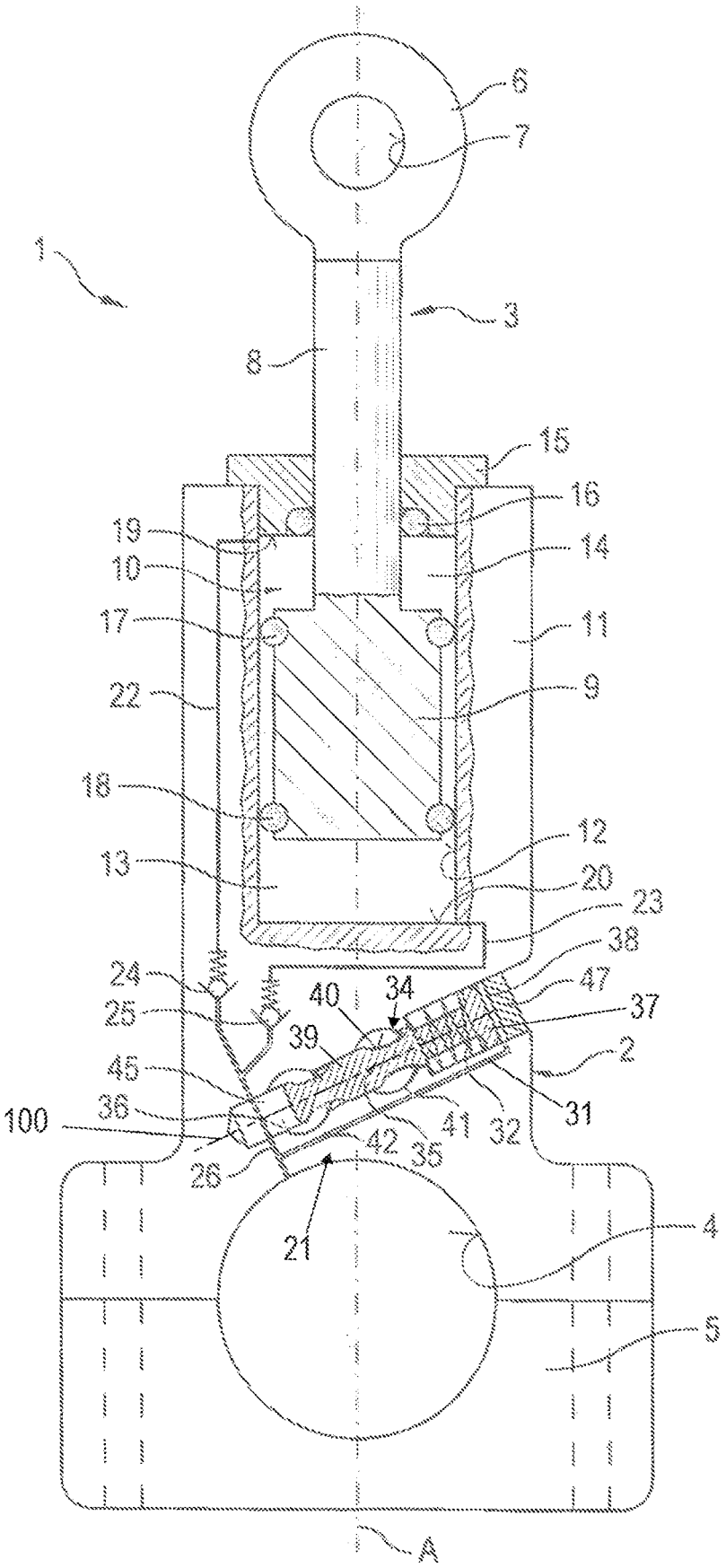
FIG. 1 shows a schematic view cut free in part of a longitudinally adjustable connecting rod according to the invention.

Longitudinally adjustable connecting rod 1 shown in the schematic view in FIG. 1 comprises two connecting rod members 2, 3 telescopically movable relative to one another. Lower connecting rod member 2, which is arranged at the bottom in the illustration of longitudinally adjustable connecting rod 1 in FIG. 1, comprises a connecting rod large end 4 with which longitudinally adjustable connecting rod 1 is mounted on the crankshaft (not shown) of the piston engine. For this purpose, a bearing shell 5 is further arranged on lower connecting rod member 2 and together with the lower region of lower connecting rod 2, which is also configured like a bearing shell, forms connecting rod large end 4. Bearing shell 5 and lower connecting rod member 2 are connected to one another by way of connecting rod screws (shown schematically as dashed lines). Upper connecting rod member 3 comprises a connecting rod head 6 with a connecting rod small end 7 which receives the piston pin (not shown) of the reciprocating piston in the piston engine. Connecting rod head 6 is connected to piston rod 8 and via piston rod 8 to adjustable piston 9 of the adjustment device of longitudinally adjustable connecting rod 1 which is presently configured as a cylinder-piston unit 10. Connecting rod head 6 is typically screwed or welded to piston rod 8, while adjustable piston 9 and piston rod 8 can then be formed integrally. This enables cylinder cover 15 of the cylinder-piston unit and rod seal 16 to be arranged on piston rod 8 as well as piston seals 17, 18 on adjustable piston 9 in a simple and damage-free manner before upper connecting rod member 3 is assembled.

Upper connecting rod member 3 guided by way of adjustable piston 9 in a telescoped manner in lower connecting rod member 2 for adjusting the distance between the piston pin of the reciprocating piston received in connecting rod small end 7 and the crankshaft of the piston engine received in connecting rod large end 4 for thus adapting the compression ratio of the piston engine to the respective operating state. This makes it possible to operate the piston engine in the partial load range with a higher compression ratio than in the full load range and to thereby increase the efficiency of the engine. Formed in housing 11 of lower connecting rod member 2 in the upper region is a cylinder 12 which is introduced into housing 11 of lower connecting rod member 2 as a cylinder bore or cylinder sleeve. Adjustable piston 9 of upper connecting rod member 3 is arranged in cylinder 12 so as to be movable in longitudinal direction A of connecting rod 1 in order to form, together with cylinder 12 and cylinder cover 15, cylinder-piston unit 10. Adjustable piston 9 is shown in FIG. 1 in a central position in which adjustable piston 9 divides cylinder 12 into two pressure chambers 13 and 14. Piston rod 8 extends from adjustable piston 9 through upper pressure chamber 14 and cylinder cover 15 which defines housing 11 and cylinder 12 towards the top. A rod seal 16 surrounding piston rod 8 is provided on cylinder cover 15 and seals upper pressure chamber 14 against the surrounding. Two piston seals 17, 18 arranged on adjustable piston 9 seal adjustable piston 9 against cylinder 12 and thereby also pressure chambers 13, 14 against one another. Underside 19 of cylinder cover 15 forms an upper stop against which adjustable piston 9 abuts in the upper position, the long position of longitudinally adjustable connecting rod 1, while in the lower position (short position) of longitudinally adjustable connecting rod 1, adjustable piston 9 abuts against the lower stop formed by cylinder base 20.

Figure 2:
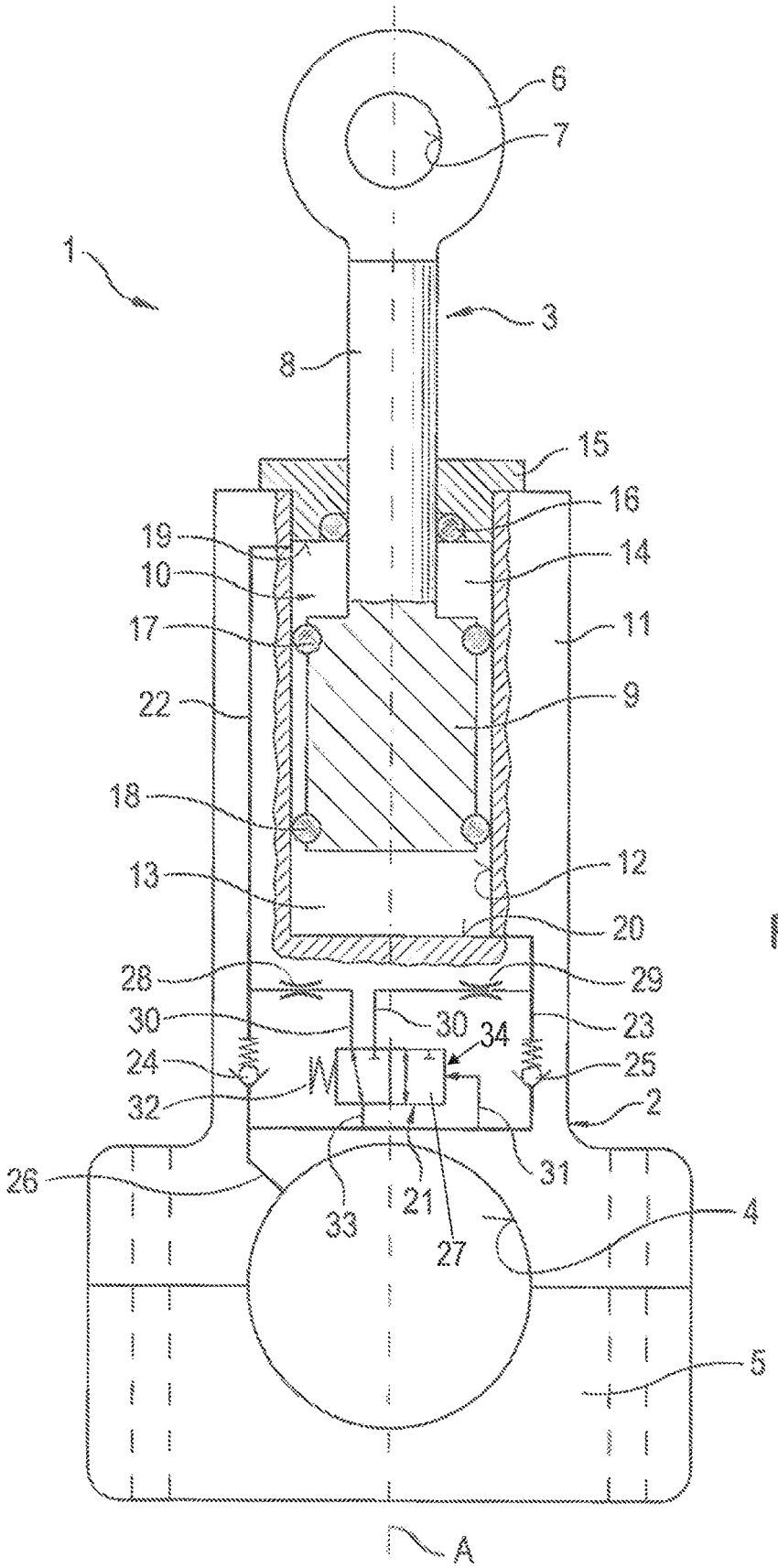
FIG. 2 shows a schematic view of the longitudinally adjustable connecting rod from FIG. 1 with a schematic representation of the hydraulic control valve.

In the following, control device 21 for supplying the adjustment device formed by cylinder-piston unit 10 shall be explained in more detail using the hydraulic interconnection shown in FIG. 2. Two pressure chambers 13, 14 are each connected to the engine oil circuit of the piston engine by way of separate hydraulic fluid lines 22, 23 and separate check valves 24, 25 and a common oil supply duct 26 which opens into connecting rod large end 4. If longitudinally adjustable connecting rod 1 is in the long position, then there is no engine oil present in upper pressure chamber 14, whereas lower pressure chamber 13 is completely filled with engine oil. During operation, connecting rod 1 is subjected to alternating pull and push forces due to the mass or acceleration forces and gas forces, respectively. In the long position, the pull force is absorbed by the mechanical contact of adjustable piston 9 with underside 19 of cylinder cover 15. The length of connecting rod 1 does not change as a result. A push force applied is transmitted via the piston surface to lower pressure chamber 13 filled with engine oil. Since check valve 25 associated with lower pressure chamber 13 prevents the engine oil from flowing out, the pressure of the engine oil rises sharply and prevents any change in the connecting rod length. As a result, longitudinally adjustable connecting rod 1 is hydraulically locked in this direction of motion. In the short version of longitudinally adjustable connecting rod 1, the situation is reversed. Lower pressure chamber 13 is completely empty and a pressure force is absorbed by the mechanical stop of adjustable piston 9 on cylinder base 20 while upper pressure chamber 14 is filled with engine oil so that a pull force upon longitudinally adjustable connecting rod 1 causes a pressure rise in upper pressure chamber 14 and therefore a hydraulic lock.

The connecting rod length of longitudinally adjustable connecting rod 1 presently shown can be adjusted in two stages by emptying one of two pressure chambers 13, 14 and filling other pressure chamber 13, 14 with engine oil. For this purpose, one of respective check valves 24, 25 is bridged by hydraulic control device 21 so that the engine oil can flow out of previously filled pressure chamber 13, 14. Respective check valve 24, 25 then loses its effect. For this purpose, hydraulic control device 21 comprises a 3/2-way valve 27, the two switchable ports 30 of which are each connected to a hydraulic fluid line 22, 23 of pressure chambers 13, 14 by way of a throttle 28, 29. 3/2-way valve 27 is actuated by the pressure of the engine oil which is supplied to 3/2-way valve 27 via a control pressure line 31 connected to oil supply duct 26. 3/2-way valve 27 is returned by a return spring 32. Two switchable ports 30 of 3/2-way valve 27 are connected to an outflow duct 33 which delivers the engine oil discharged from pressure chambers 13, 14 to oil supply duct 26, from where it is available for filling respective other pressure chamber 14, 13 or it can be delivered to the surrounding via connecting rod large end 4. In the preferred position of 3/2-way valve 27 shown in FIG. 2, upper pressure chamber 14 is open. Alternatively, outflow duct 33 can deliver the engine oil directly into the surrounding.

One of respective switchable ports 30 is open in 3/2-way valve 27 so that associated pressure chamber 13, 14 is emptied while other port 30 is closed. When the switching position of 3/2-way valve 27 changes by applying a higher control pressure via control pressure line 31 or by a return action of return spring 32 while the control pressure drops, previously open port 30 is closed and previously closed port 30 is opened. As a result, the highly pressurized engine oil flows from pressure chamber 13, 14, previously filled with engine oil, via respective hydraulic fluid line 22, 23 as well as associated throttle 28, 29 through open port 30 of 3/2-way valve 27 and outflow duct 33 to the surrounding. At the same time, the mass and gas forces acting in a piston engine during the stroke motion of connecting rod 1 create a suction effect in previously empty pressure chamber 14, 13, due to which associated check valve 24, 25 opens, so that previously empty pressure chamber 14, 13 fills with engine oil. With increased filling of this pressure chamber 14, 13, the engine oil is increasingly discharged from other pressure chamber 13, 14 via open port 30, whereby the length of connecting rod 1 changes. Depending on the configuration of longitudinally adjustable connecting rod 1 and hydraulic control device 21 and the operating state of the piston engine, several strokes of connecting rod 1 may be required until pressure chamber 14, 13 blocked by hydraulic control device 21 is completely filled with engine oil and other open pressure chamber 13, 14 is completely emptied and the maximum possible change in length of connecting rod 1 is then obtained.

Hydraulic control device 21 shown in FIG. 1 comprises a hydraulic control valve 34 designed as a slide valve with a control cylinder 36 and a mushroom-shaped control slide 35 arranged in a slidable manner in control cylinder 36. Control slide 35 comprises a control piston 37 arranged on the end-face which together with control cylinder 36 forms a control pressure chamber 38 arranged on the end face of control slide 35. Control cylinder 36 is configured as a stepped bore in housing 11 of lower connecting rod member 2 and inclined with respect to longitudinal direction A of connecting rod 1 and also with respect to the normal to longitudinal direction A of connecting rod 1. A closure cap 47 is provided at the open end of control cylinder 36 and seals control pressure chamber 38 against the surrounding. Control pressure chamber 38 is supplied from oil supply duct 26 via control pressure line 31 with hydraulic fluid that is subject to control pressure. On the rear side of end-face control piston 37 facing away from control pressure chamber 38, a slide tappet 39 extends in the lower end of the control cylinder 36 configured as a low-pressure chamber 45, for which reason a contacting or contactless seal is provided between end-face control piston 37 and control cylinder 36. Return spring 32 is arranged around slide tappet 39 on an upper section of slide tappet 39 facing control piston 37, while a switching contour 40 for opening and closing outlet valves 41, 42 is formed at the lower end of slide tappet 39 for lifting respective valve body 43 evenly from valve seat 44 of first and second outlet valve 41, 42 and for opening respective outlet valve 41, 42 with as little force exerted as possible.

Figure 3:
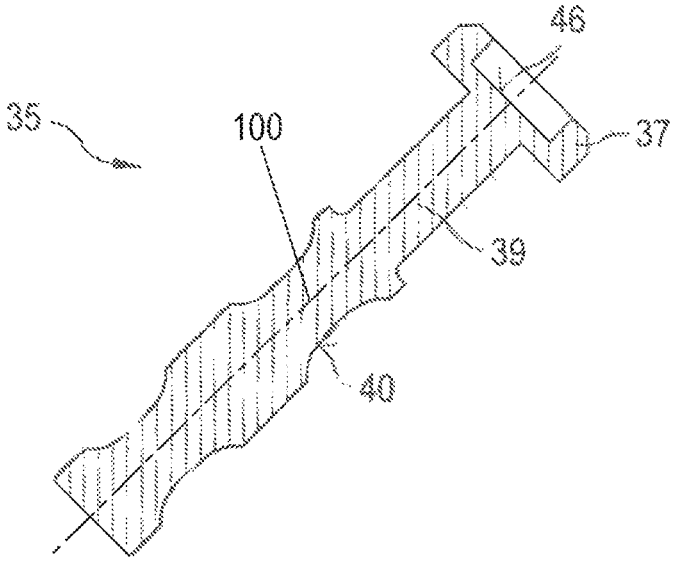
FIG. 3 shows a sectional view of the control slide of the hydraulic control valve from FIG. 1.

FIG. 3 shows an enlarged sectional view of control slide 35 from slide valve 34 shown in FIG. 1. The head of this mushroom-shaped control slide 35 is there configured as a control piston 37 with an end-face depression for reducing the mass of control slide 35 and for enlarging control pressure chamber 38 disposed at the end face in control cylinder 36. The shaft of control slide 35 in the upper region comprises an upper section with a small diameter around which return spring 32 is arranged, as well as a lower front region with a switching contour 40 which, in addition to a guide for control slide 35, is provided with circumferential depressions which are in engagement with two outlet valves 41, 42 for opening associated pressure chambers 13, 14 alternately from the closed state.

When supplying control pressure chamber 38 with a hydraulic fluid subject to high control pressure via oil supply duct 26 and control pressure line 31, the pressure in control pressure chamber 38 increases and presses control slide 35 in the direction of control slide axis 100 into control cylinder 36 against the preload of return spring 32, which is supported on a step in control cylinder 36, into the lower end of control cylinder 36 in order to open first outlet valve 41 and to close second outlet valve 42 at the same time. Formed between slide tappet 39 of control slide 35 and control cylinder 36 is presently low-pressure chamber 45 via which the hydraulic fluid flowing out of upper pressure chamber 14 via opened first outlet valve 41 is discharged to the surrounding of longitudinally adjustable connecting rod 1. Alternatively, low-pressure chamber 45 can also be connected to oil supply duct 26 in order to provide the outflowing engine oil directly for filling lower pressure chamber 13. In the preferred position of hydraulic control valve 34 shown in FIG. 1, only a low hydraulic control pressure is present via oil supply duct 26 and control pressure line 31 in control pressure chamber 38, so that the force acting upon control piston 37 by return spring 32 is greater than the force of the hydraulic fluid subject to low control pressure in control pressure chamber 38 acting upon control pressure surface 46. In this position, switching contour 40 pushes valve body 43 of first outlet valve 41 out of its valve seat 44. The hydraulic fluid then flows through this open first outlet valve 41 from upper pressure chamber 14 via hydraulic fluid line 22 into outlet valve 41 and from there via low pressure chamber 45 into oil supply duct 26 or directly into the surrounding of longitudinally adjustable connecting rod 1. At the same time, second outlet valve 42 is closed so that lower pressure chamber 13 is permanently blocked and the engine oil flowing into lower pressure chamber 13 via oil supply duct 26 and check valve 25 presses adjustable piston 9 of cylinder-piston unit 10 in the direction of cylinder cover 15 until the long position of connecting rod 1 has been reached. As shown in FIG. 2, port 30 of hydraulic fluid lines 22, 23 at outlet valves 41, 42 can be throttled in order to prevent the engine oil from flowing out of pressure chambers 13, 14 too quickly and in an uncontrolled manner.

Figure 4:
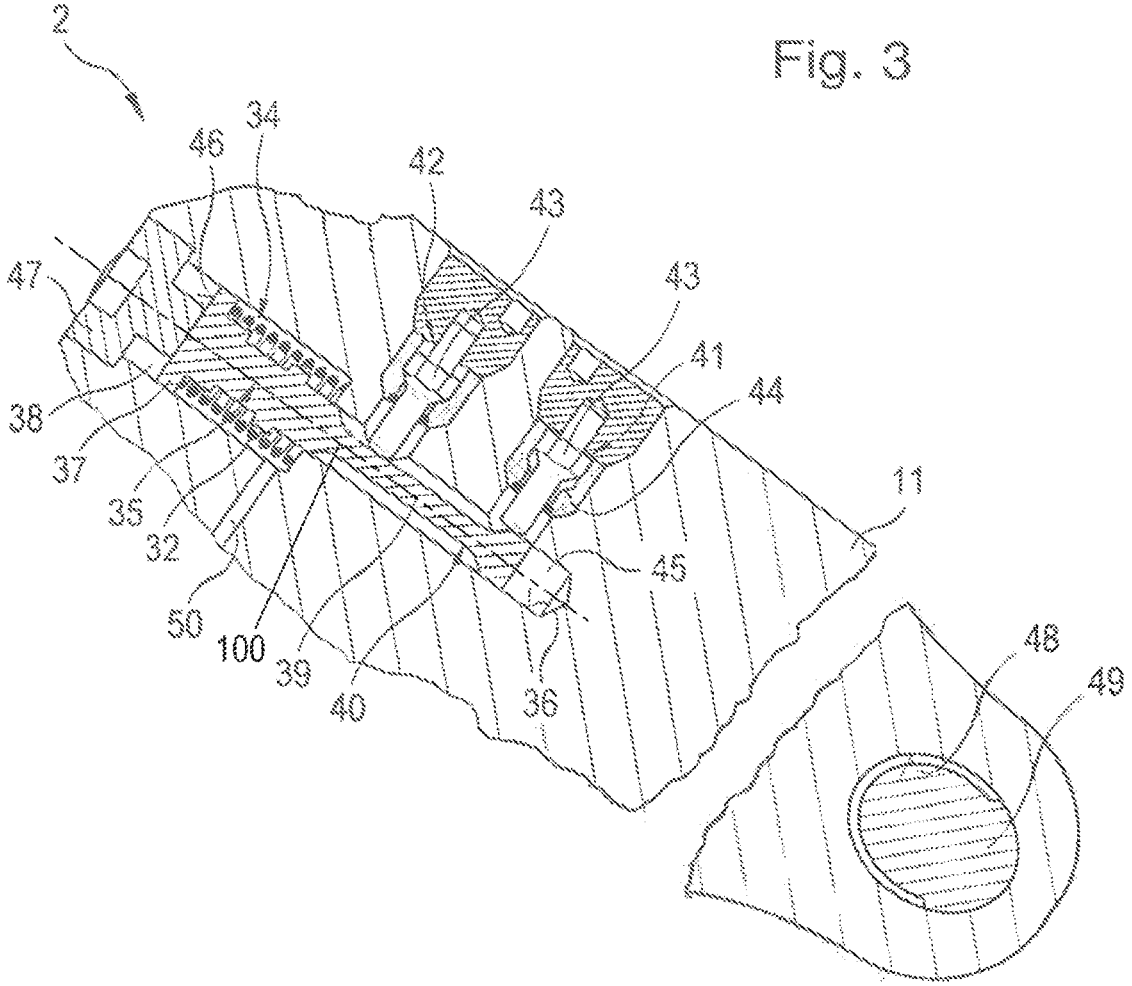
FIG. 4 shows a sectional view through a hydraulic control valve for the longitudinally adjustable connecting rod from FIG. 1 transverse to the longitudinal direction of the connecting rod.

FIG. 4 shows a sectional view through a longitudinally adjustable connecting rod 1 with a different variant of control valve 34. The sectional view runs in the slide longitudinal direction of control slide 35 transverse to longitudinal direction A of longitudinally adjustable connecting rod 1 and through outlet valves 41, 42. In addition to slide valve 34 and two outlet valves 41, 42, also screw hole 48 through housing 11 of lower connecting rod member 2 which is used for receiving a connecting rod screw 49 with which bearing shell 5 is fastened to the lower region of housing 11 is clearly visible in this sectional view Control slide 35, which is guided in a slidable manner n control cylinder 36, also in this embodiment comprises an end-face control piston 37 and a slide tappet 39 with a switching contour 40 extending into low-pressure chamber 45 at the lower end of control cylinder 36. A return spring 32 is again arranged around the upper section of slide tappet 39 and causes a return of control slide 35 when the control pressure in control pressure chamber 38 decreases. Control pressure chamber 38 extends in control cylinder 36 from end-face control pressure surface 46 of control piston 37 to closure cap 47. In order to ensure rapid and delay-free adjustment of control slide 35 when the control pressure in control pressure chamber 38 rises, the region filled by return spring 32 between control slide 35 and control cylinder 36 is vented through a drain duct 50, so that control slide 35 only needs to move against the restoring force of return spring 32 when a high control pressure prevails in control pressure chamber 38. Outlet valves 41, 42, which are connected to pressure chambers 13, 14 via corresponding throttles 28, 29 and hydraulic fluid lines 22, 23 (see FIG. 2), are alternately opened and closed depending on the position of control slide 35.

Figure 5:
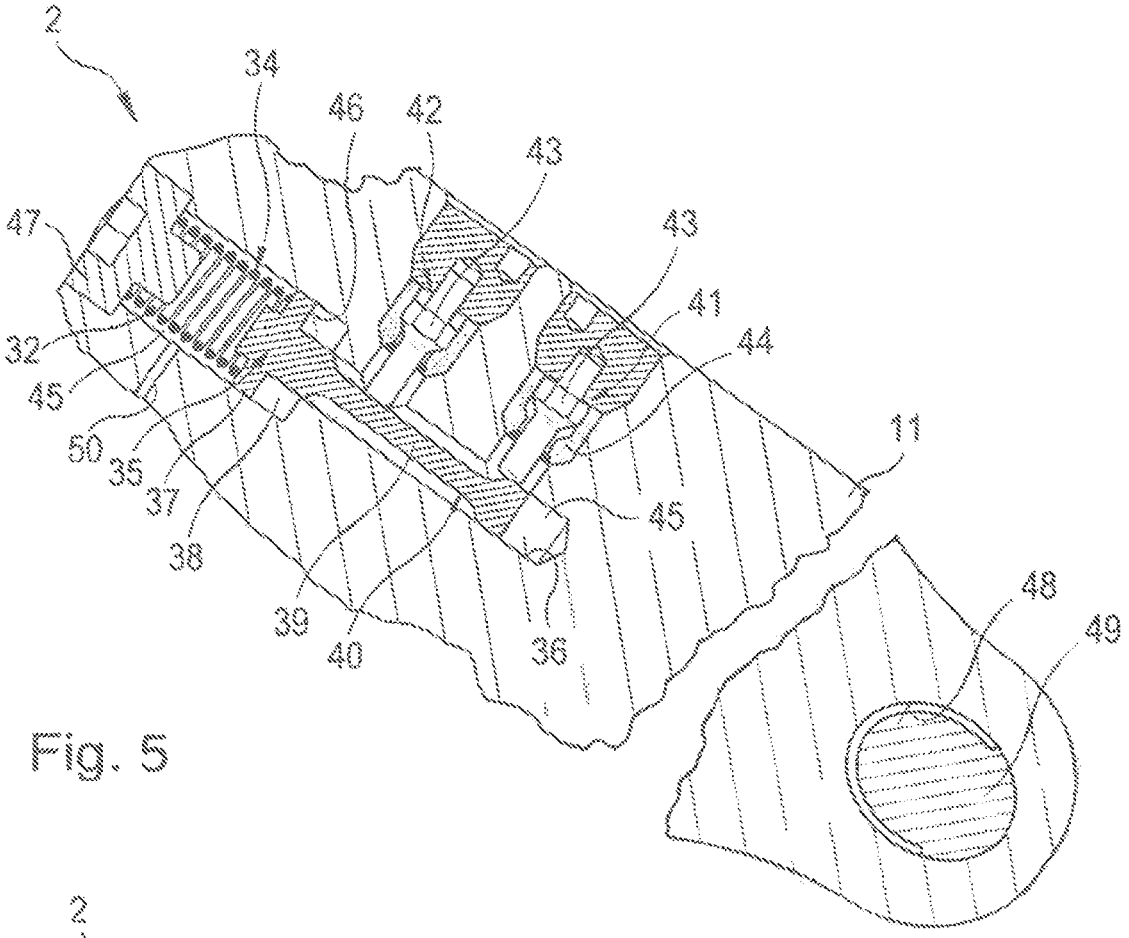
FIG. 5 shows a sectional view through a further hydraulic control valve for the longitudinally adjustable connecting rod from FIG. 1 transverse to the longitudinal direction of the connecting rod.

A further variant of hydraulic control valve 34 is shown in FIG. 5. In contrast to control valves 34 shown in FIGS. 1 and 4, control pressure chamber 38 is there arranged on the rear side of end-face control piston 37 and return spring 32 is arranged between control piston 37 closure cap 47. There as well, low-pressure chamber 45 receiving return spring 32 is vented via a drain duct 50 in order to ensure rapid and delay-free adjustment of control slide 35 when the control pressure in control pressure chamber 38 rises. In the position of hydraulic control valve 34 shown in FIG. 5, there is a high hydraulic control pressure present above oil supply duct 26 and control pressure line 31 (see FIG. 2) in control pressure chamber 38 which acts upon ring-shaped control pressure surface 46 of control piston 37. The force acting by the hydraulic fluid upon control pressure surface 46 of control piston 37 is greater than the preloading force acting upon control slide 35 by return spring 32. Switching contour 40 of slide tappet 39 therefore opens second outlet valve 42, where switching contour 40 presses valve body 43 of second outlet valve 42 out of its valve seat 44. Hydraulic fluid then flows through this open second outlet valve 42 from lower pressure chamber 13 via hydraulic fluid line 23 into outlet valve 42 and from there via a drainage duct (not shown) that opens into control cylinder 36 into oil supply duct 26 or into the surrounding of longitudinally adjustable connecting rod 1. At the same time, first outlet valve 41 is closed so that upper pressure chamber 14 is hydraulically blocked and the engine oil flowing into upper pressure chamber 14 via oil supply duct 26 and check valve 24 presses adjustable piston 9 of cylinder-piston unit 10 in the direction of cylinder base 20 until the short position of longitudinally adjustable connecting rod 1 has been reached.

Figure 6:
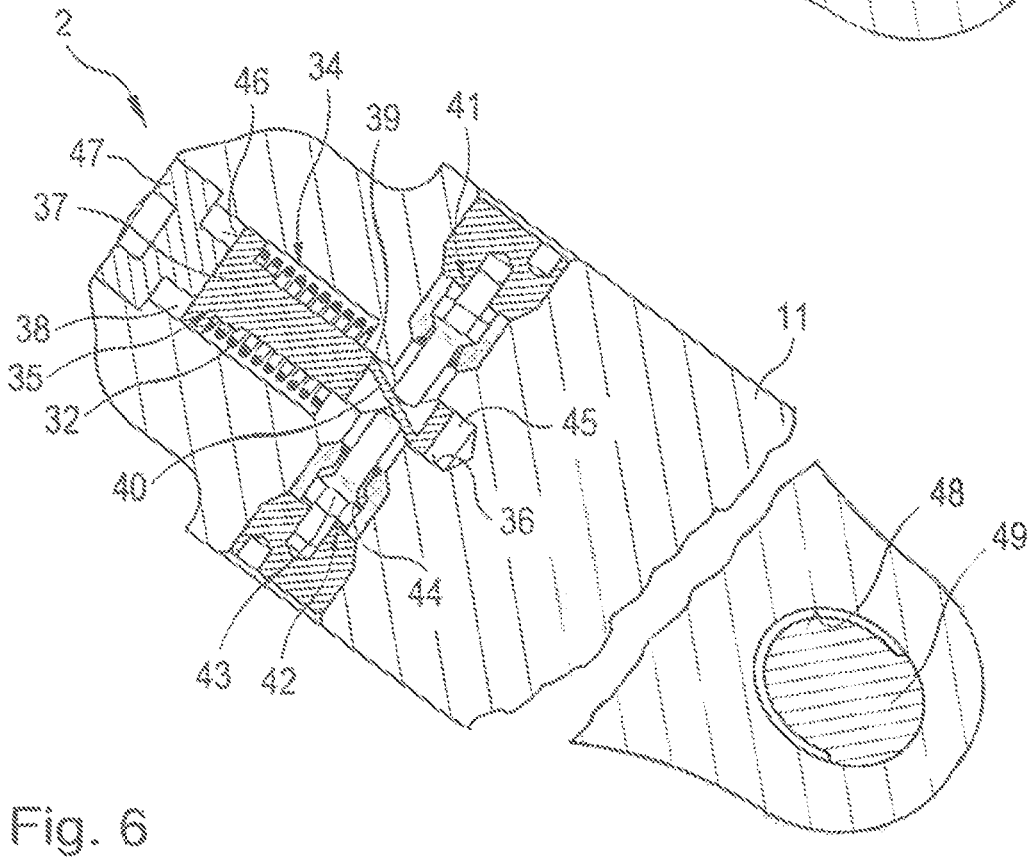
FIG. 6 shows a sectional view through a different hydraulic control valve for the longitudinally adjustable connecting rod from FIG. 1 transverse to the longitudinal direction of the connecting rod.

FIG. 6 shows a further embodiment of hydraulic control valve 34 for longitudinally adjustable connecting rod 1 shown in FIG. 1. Here as well, the sectional view runs in the slide longitudinal direction of control slide 35 transverse to longitudinal direction A of longitudinally adjustable connecting rod 1 and through outlet valves 41, 42. Like in the embodiments of FIGS. 1 and 4, control pressure surface 46 of end-face control piston 37 is arranged on the outer side of control slide 35, so that control pressure chamber 38 is formed between control piston 37 and closure cap 47 of control cylinder 36. Return spring 32 is likewise again arranged on the rear side of control piston 37 in low pressure 35 around slide tappet 39. For further details regarding the structural configuration of control valve 34 and the mode of operation of the outlet valves 41, 42, reference is made to FIGS. 1 and 4 In contrast to the variants of control valve 34 in FIGS. 1 and 4, outlet valves 41, 42 are arranged opposite one another, so that outlet valves 41, 42 are actuated by the same section of slide tappet 39. For this the slide tappet 39 comprises a switching contour 40 in the region of outlet valves 41, 42 formed as an inclined, flattened profile with which outlet valves 41, 42 are alternately opened and closed. The oppositely disposed arrangement of outlet valves 41, 42 enables a very short slide tappet 39 or control slide 35, respectively, and thereby a very slim design of longitudinally adjustable connecting rod 1.

LIST OF REFERENCE CHARACTERS

1 longitudinally adjustable connecting rod
2 lower connecting rod member
3 upper connecting rod member
4 connecting rod end
5 bearing shell
6 connecting rod head
7 connecting rod end
8 piston rod
9 adjustable piston
10 cylinder-piston unit
11 housing
12 cylinder
13 pressure chamber
14 pressure chamber
15 cylinder cover
16 rod seal
17 piston seal
18 piston seal
19 underside
20 cylinder base
21 hydraulic control device
22 hydraulic fluid line
23 hydraulic fluid line
24 check valve
25 check valve
26 oil supply
27 3/2-way valve
28 throttle
29 throttle
30 ports
31 control pressure line
32 return spring
33 outflow duct
34 control valve
35 control slide
36 control cylinder
37 control piston
38 control pressure chamber
39 slide tappet
40 switching contour
41 outlet valve
42 outlet valve
43 valve body
44 valve seat
45 low pressure chamber
46 control pressure area
47 closure cap
48 screw bore
49 connecting rod screw
50 drain duct
100 control slide axis
A longitudinal direction

The invention claimed is:

1. A longitudinally adjustable connecting rod for a piston engine, where said connecting rod comprises a first connecting rod end for receiving a piston pin and a second connecting rod end for receiving a crankshaft journal, where the distance between said piston pin and said crankshaft journal is adjustable in a longitudinal direction (A) of said connecting rod by way of a control device with a hydraulic control valve, and said hydraulic control valve comprises a control cylinder, a control slide which is guided in a slidable manner in said control cylinder and which can be pressurized with a hydraulic control pressure, and at least one outlet valve which can be actuated by said control slide, wherein said control slide comprises a control piston arranged on an end face, where said control piston comprises a control pressure surface which can be subjected to the hydraulic control pressure and which defines a control pressure chamber in said control cylinder.

2. The longitudinally adjustable connecting rod according to claim 1, wherein said control pressure surface which can be subjected to the hydraulic control pressure is arranged on the end face of said control piston of said control slide.

3. The longitudinally adjustable connecting rod according to claim 1, wherein said control slide comprises a slide tappet, where said slide tappet extends from said control piston arranged at the end face through said control cylinder for actuating said at least one outlet valve.

4. The longitudinally adjustable connecting rod according to claim 3, wherein said slide tappet extends in the direction of a control slide axis through said control cylinder.

5. The longitudinally adjustable connecting rod according to claim 3, wherein said slide tappet comprises a switching contour for actuating said at least one outlet valve.

6. The longitudinally adjustable connecting rod according to claim 1, wherein at least two outlet valves which can be actuated by said control slide are provided.

7. The longitudinally adjustable connecting rod according to claim 6, wherein said at least two outlet valves are arranged inclined relative to a control slide axis.

8. The longitudinally adjustable connecting rod according to claim 6, wherein said at least two outlet valves are arranged on oppositely disposed sides of a control slide axis.

9. The longitudinally adjustable connecting rod according to claim 6, wherein said at least two outlet valves can be actuated alternately by the control slide.

10. The longitudinally adjustable connecting rod according to claim 1, wherein said hydraulic control device comprises a return spring for retaining said control slide in a first initial position or to return it to the first initial position.

11. The longitudinally adjustable connecting rod according to claim 1, wherein said control slide is arranged inclined relative to the longitudinal direction (A) of said connecting rod and inclined to the normal to the longitudinal direction (A) of said connecting rod.

12. The longitudinally adjustable connecting rod according to claim 1, wherein two connecting rod members are provided, where the first connecting rod member comprises said first connecting rod end and the second connecting rod member comprises said second connecting rod end and where said first connecting rod member is movable.

13. The longitudinally adjustable connecting rod according to claim 12, wherein at least one cylinder-piston unit hydraulically connected to said hydraulic control device is provided for moving said first connecting rod member relative to said second connecting rod member, where said first connecting rod member is connected to an adjustable piston of said cylinder-piston unit and said second connecting rod member comprises a cylinder bore of said cylinder-piston unit.

14. A use of a longitudinally adjustable connecting rod with a hydraulic control valve in a piston engine, where said hydraulic control valve of said control device comprises a control cylinder, a pressurized control slide, and at least two outlet valves, and said control slide comprises a control piston arranged on the end face, where said control piston comprises a control pressure surface which defines a control pressure chamber in said control cylinder, where the use of the longitudinally adjustable connecting rod comprises guiding the control slide in a slidable manner in said control cylinder and pressurizing the control slide, and subjecting the control pressure surface to the hydraulic control pressure.

15. A piston engine with at least one engine cylinder, a reciprocating piston moving in said engine cylinder, and at least one adjustable compression ratio in said engine cylinder, and with a longitudinally adjustable connecting rod connected to said reciprocating piston according to claim 1.

16. The longitudinally adjustable connecting rod according to claim 4, wherein said slide tappet is formed to be rotationally symmetrical to said control slide axis.

17. The longitudinally adjustable connecting rod according to claim 7, wherein said at least two outlet valves are arranged perpendicular to said control slide axis.

18. The longitudinally adjustable connecting rod according to claim 8, wherein said at least two outlet valves are arranged perpendicular to said control slide axis.

19. The longitudinally adjustable connecting rod according to claim 10, wherein said return spring is arranged around said control slide.

20. The longitudinally adjustable connecting rod according to claim 11, wherein said control slide is arranged inclined relative to the longitudinal direction (A) of said connecting rod and inclined to the normal to the longitudinal direction (A) of said connecting rod at an angle between 15° and 75°.

21. The longitudinally adjustable connecting rod according to claim 12, wherein said first connecting rod member is telescopically movable relative to said second connecting rod member in the longitudinal direction (A) of said connecting rod for adjusting the distance between said piston pin and said crankshaft journal.

* * * * *